US008725040B2

(12) United States Patent
Ryu

(10) Patent No.: US 8,725,040 B2
(45) Date of Patent: May 13, 2014

(54) IMAGE FORMING APPARATUS WITH SPEED CONTROL FUNCTION

(75) Inventor: Gunmun Ryu, Osaka (JP)

(73) Assignee: Kyocera Mita Corporation (JP)

( * ) Notice: Subject to any disclaimer, the term of this patent is extended or adjusted under 35 U.S.C. 154(b) by 411 days.

(21) Appl. No.: 12/840,750

(22) Filed: Jul. 21, 2010

(65) Prior Publication Data

US 2011/0026994 A1 Feb. 3, 2011

(30) Foreign Application Priority Data

Jul. 30, 2009 (JP) ..... 2009-178177

(51) Int. Cl.
*G03G 15/00* (2006.01)

(52) U.S. Cl.
USPC ..... 399/167; 399/301

(58) Field of Classification Search
USPC ..... 399/301, 167
See application file for complete search history.

(56) References Cited

U.S. PATENT DOCUMENTS 6,215,119 B1 * 4/2001 Markham et al. ..... 250/231.14
7,376,375 B2 * 5/2008 Kobayashi et al. ..... 399/301
7,460,820 B2 * 12/2008 Okabe ..... 399/301
8,244,157 B2 * 8/2012 Shirakata et al. ..... 399/167
2003/0081965 A1 * 5/2003 Ueda et al. ..... 399/167
2006/0088338 A1 * 4/2006 Matsuda et al. ..... 399/167
2006/0165442 A1 7/2006 Kobayashi et al.
2006/0184258 A1 * 8/2006 Matsuda et al. ..... 399/167
2008/0247781 A1 * 10/2008 Matsuda et al. ..... 399/162
2009/0190972 A1 * 7/2009 Ohkubo et al. ..... 399/301

FOREIGN PATENT DOCUMENTS

JP 2000310897 A * 11/2000 ..... G03G 15/01
JP 2004123383 A * 4/2004 ..... G03G 15/00
JP 2006-23403 1/2006
JP 2006-235560 9/2006

* cited by examiner

*Primary Examiner* — Nguyen Ha
(74) *Attorney, Agent, or Firm* — Gerald E. Hespos; Michael J. Porco; Matthew T. Hespos

(57) ABSTRACT

An image forming apparatus configured to form a toner image on a sheet, including: a transfer belt configured to bear and transfer the toner image to the sheet conveyed at given conveying speed; a drive roller configured to drive the transfer belt; a speed detection roller held in contact with the transfer belt and configured to output roller information on rotational speed of the speed detection roller when the speed detection roller rotates as the transfer belt runs; a motor configured to drive the drive roller; a motor speed output portion configured to output motor information on rotational speed of the motor; and a control element configured to control the rotational speed of the motor.

11 Claims, 7 Drawing Sheets

IMAGE FORMING APPARATUS WITH SPEED CONTROL FUNCTION

BACKGROUND OF THE INVENTION

1. Field of the Invention

The present invention relates to an image forming apparatus with a speed control function. More particularly, the present invention relates to the image forming apparatus which executes speed control to reduce speed variation of a tandem MFP (Multi-Function Product/Printer/Peripheral).

2. Detailed Description of the Related Art

A tandem MFP configured to form a full color image typically includes a transfer belt and image forming units. The image forming units electrophotographically form different single colored toner images, respectively, to form a full color image by superimposing these toner images one over another on the transfer belt. The full color image is transferred from the transfer belt to a sheet.

The transfer belt is wound around a drive roller and an idle roller in many cases. The drive roller rotated by a motor causes the transfer belt to run. The running speed of the transfer belt varies depending on various factors (e.g. accuracy in deceleration of a decelerator, accuracy in diameter of the drive roller, variation in thickness of the transfer belt, and expansion/contraction of the transfer belt). Accordingly, it is not sufficient to keep the running speed of the transfer belt at desired speed only by keeping rotating speed of the motor constant.

A specific image forming apparatus detects an error, which relates to running speed of a transfer belt, resulting from variation in thickness of the transfer belt. The detected error is used for the speed control of the transfer belt. In order to detect the error in the running speed of the transfer belt, a speed detection roller is typically used. The speed detection roller rotates as the transfer belt runs.

The dimensional accuracy of the speed detection roller (e.g. accuracy in diameter and eccentricity) directly affects the error detection for the running speed of the transfer belt. The above image forming apparatus does not make any correction for the dimensional accuracy of the speed detection roller. Accordingly, feedback control for the running speed of the transfer belt is executed based on a detection amount including a reading error generated during one revolution of the speed detection roller. Thus, according to the prior art, variation in the running speed of the transfer belt resulting from the reading error of the speed detection roller is newly generated. Alternatively a speed detection roller is very accurately fabricated in order to reduce the effect from the reading error of the speed detection roller.

SUMMARY OF THE INVENTION

An object of the present invention is to provide an image forming apparatus which makes a correction to reduce variation in running speed of a transfer belt.

One aspect of the present invention is directed to an image forming apparatus configured to form a toner image on a sheet, including: a transfer belt configured to bear and transfer the toner image to the sheet conveyed at given conveying speed; a drive roller configured to drive the transfer belt; a speed detection roller held in contact with the transfer belt and configured to output roller information on rotational speed of the speed detection roller when the speed detection roller rotates as the transfer belt runs; a motor configured to drive the drive roller; a motor speed output portion configured to output motor information on rotational speed of the motor; and a control element configured to control the rotational speed of the motor, wherein the control element includes: a reference speed generator configured to generate first reference speed as a reference for the rotational speed of the motor and second reference speed as a reference for the rotational speed of the speed detection roller based on the given conveying speed of the sheet; a first controller configured to generate a first error signal for reducing a difference between the rotational speed of the motor obtained from the motor information and the first reference speed; a second controller configured to generate a second error signal for reducing a difference between the rotational speed of the speed detection roller obtained from the roller information and the second reference speed; and an adder configured to add the first and second error signals and output a drive signal for driving the motor.

Objects, features and advantages of the present invention will become more apparent upon reading the following detailed description along with the accompanying drawings.

DETAILED DESCRIPTION OF THE PREFERRED EMBODIMENTS

Hereinafter, one embodiment according to the present invention is described with reference to the accompanying drawings. Direction-indicating terms such as "upper", "lower", "left" and "right" are merely used in the following description for the purpose of clarifying the description and should not be interpreted in any limited manner. A term "sheet" used in the following description means a copy sheet, tracing paper, a cardboard, an OHP sheet or another sheet on which an image may be formed.

(Image Forming Apparatus)

Figure 1:
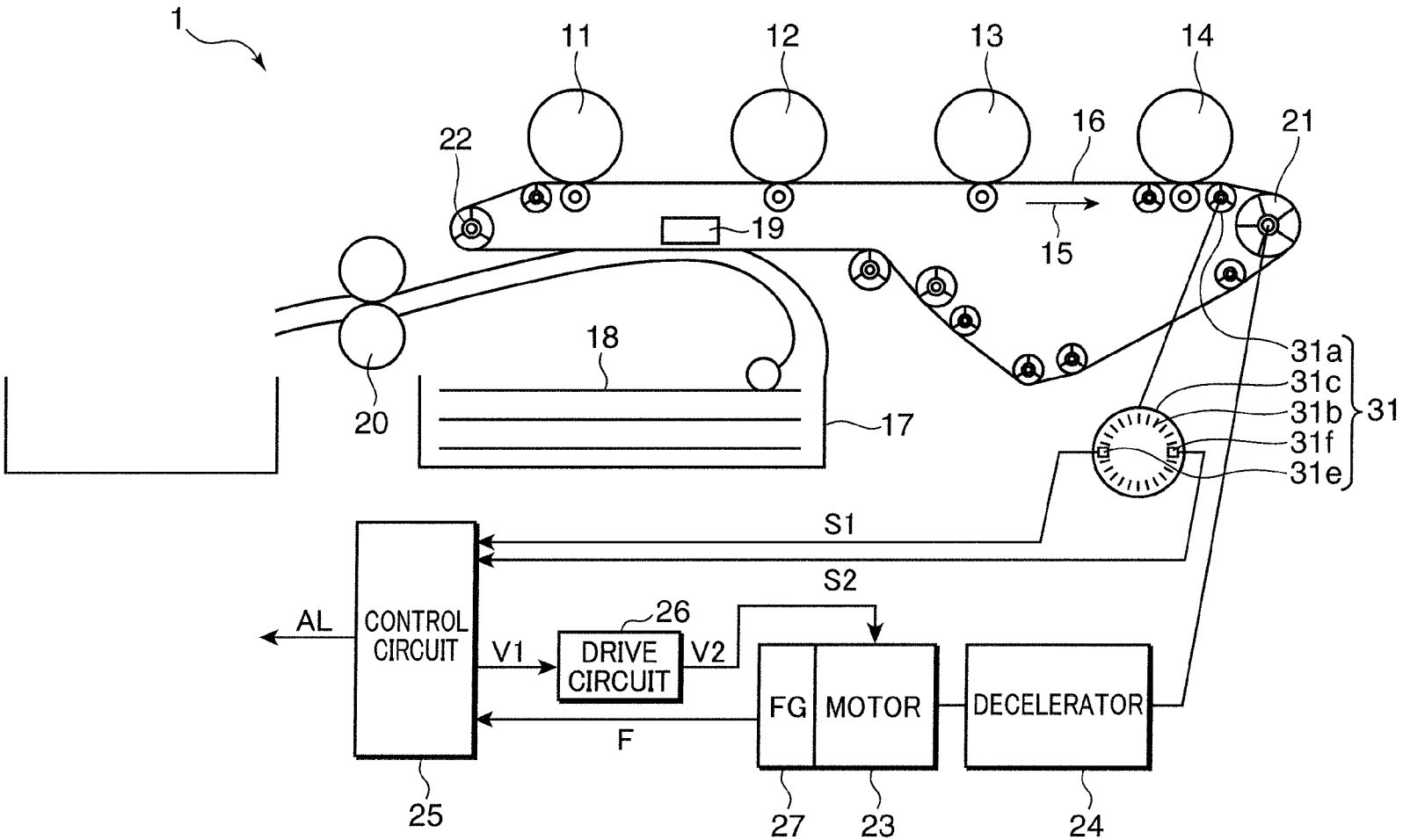
FIG. 1 is a schematic diagram showing a configuration of an image forming apparatus according to one embodiment of the invention.

FIG. 1 is a schematic diagram showing a configuration of an image forming apparatus. It should be noted that FIG. 1 shows the configuration necessary to describe a principle according to the embodiment. Accordingly, the image forming apparatus may include other constructions not shown in FIG. 1. The image forming apparatus shown in FIG. 1 is a tandem MFP. Alternatively, a printer other than the tandem MFP, a copier or a facsimile machine may be used as an image forming apparatus configured to form a toner image on a sheet.

The image forming apparatus 1 includes four image forming units 11, 12, 13 and 14. The image forming units 11, 12, 13 and 14 electrophotographically form, for example, magenta, yellow, cyan and black toner images, respectively.

The image forming apparatus 1 further includes a transfer belt 16 configured to bear the toner images. The transfer belt 16 runs in a direction indicated by an arrow 15. The Magenta, yellow, cyan and black toner images formed by the image forming units 11, 12, 13 and 14 are superimposed one over another on the transfer belt 16 to form a full color toner image. The full color toner image on the transfer belt 16 is transferred to a sheet 18 conveyed at given speed.

The image forming apparatus 1 includes a drive roller 21 configured to drive the transfer belt 16 and a driven roller 22 configured to rotate as the transfer belt 16 runs. The transfer belt 16 is wound around the drive roller 21 and the driven roller 22. The image forming apparatus 1 also includes a transfer device 19 arranged in an area surrounded by the transfer belt 16 wound around the drive roller 21 and the driven roller 22, and a sheet feed tray 17 configured to accommodate the sheet 18. The sheet 18 fed from the sheet feed tray 17 is conveyed toward the transfer device 19, which then transfers the full color toner image from the transfer belt 16 to the sheet 18.

The image forming apparatus 1 further includes a fixing device 20. The sheet 18 bearing the full color toner image is conveyed toward the fixing device 20, which then fixes the full color toner image to the sheet 18.

The image forming apparatus 1 further includes a motor 23 configured to drive and rotate the drive roller 21. The transfer belt 16 runs in the direction indicated by the arrow 15 by the rotation of the drive roller 21 driven by the motor 23. Optionally, the image forming apparatus 1 may also include a tension roller configured to stabilize the running of the transfer belt 16 and a guide roller configured to define a running path of the transfer belt 16.

The image forming apparatus 1 further includes a decelerator 24 configured to reduce rotational speed transmitted from the motor 23 at a given ratio and transmit it to the drive roller 21.

The image forming apparatus 1 further includes a control circuit 25 and a drive circuit 26. The control circuit 25 outputs a drive signal V1. The drive circuit 26 outputs a drive signal V2 in response to the drive signal V1. The drive circuit 26 outputs the drive signal V2 for accelerating the motor 23 in accordance with the drive signal V1, for example, when the drive signal V1 indicates certain amplitude of acceleration. The drive circuit 26 outputs the drive signal V2 for reducing the speed of the motor 23 in accordance with the drive signal V1, for example, when the drive signal V1 indicates certain amplitude of deceleration. The motor 23 is driven based on the drive signal V2.

The image forming apparatus 1 further includes a frequency generator (FG) or a tach-generator 27. The FG 27 is exemplified as a motor speed output portion configured to output motor information on the rotational speed of the motor 23. The FG 27 connected to the motor 23 is coaxial with a rotational axis of the motor 23. For example, the FG 27 and the motor 23 may be a servo motor. Actual rotational speed F detected by the FG 27 is input to the control circuit 25 as the motor information on the rotational speed of the motor 23.

The image forming apparatus 1 further includes a speed detection roller 31 configured to measure actual running speed of the transfer belt 16. The speed detection roller 31 held in close contact with the transfer belt 16 rotates as the transfer belt 16 runs.

(Construction of the Control Circuit)

Figure 2:
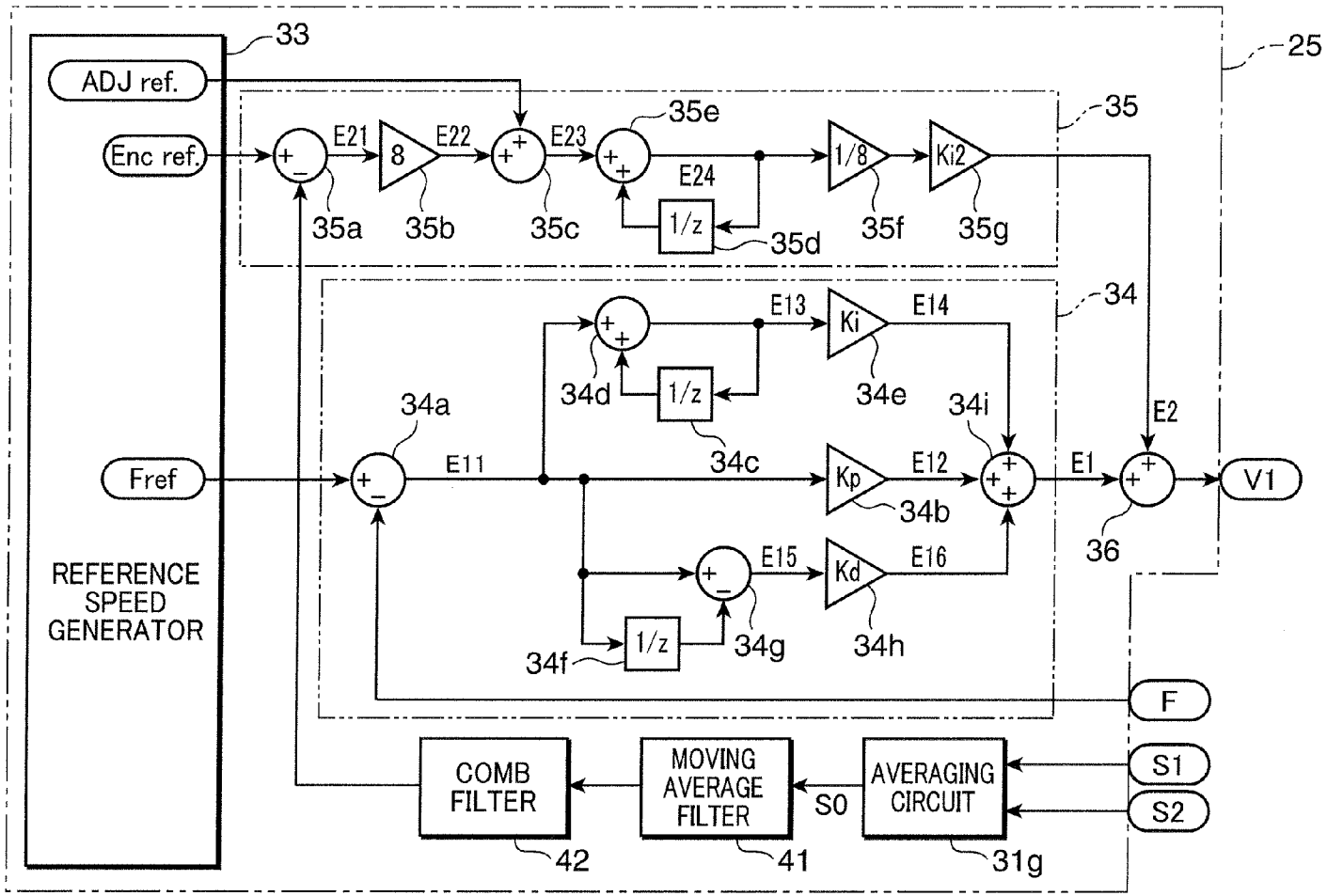
FIG. 2 is a block diagram showing a control circuit of the image forming apparatus shown in FIG. 1.

FIG. 2 is a schematic block diagram of the control circuit 25. With reference to FIGS. 1 and 2, the control circuit 25 is described. In the embodiment, the control circuit 25 is exemplified as a control element configured to control the rotational speed of the motor 23.

The control circuit 25 includes a first controller 34, a second controller 35, a reference speed generator 33 and an adder 36. The first controller 34 controls the rotational speed of the motor 23 based on the actual rotational speed F of the motor 23 detected by the FG 27. The second controller 35 controls the rotational speed of the motor 23 based on a speed signal S0 indicating the actual rotational speed of the speed detection roller 31.

The reference speed generator 33 generates reference data on reference rotational speed. The reference data includes first reference speed $F_{ref}$ as a reference for the rotational speed of the motor 23 and second reference speed $ENC_{ref}$ as reference for the rotational speed of the speed detection roller 31. The first reference speed $F_{ref}$ may be the rotational speed of the motor 23 arithmetically determined from a sheet conveying speed of the image forming apparatus 1, a deceleration ratio of the decelerator 24 and diameter of the drive roller 21. The second reference speed $ENC_{ref}$ may be the rotational speed of the speed detection roller 31 arithmetically calculated from the sheet conveying speed of the image forming apparatus 1 and diameter of the speed detection roller 31.

The first controller 34 compares the first reference speed $F_{ref}$ with the actual rotational speed F of the motor 23 detected by the FG 27 to output a first error signal E1. The control circuit 25 adjusts the rotational speed of the motor 23 based on the first error signal E1 so as to reduce a difference between the first reference speed $F_{ref}$ and the actual rotational speed F.

The second controller 35 compares the second reference speed $ENC_{ref}$ with the actual rotational speed of the speed detection roller 31 indicated by the speed signal S0 to output a second error signal E2. The control circuit 25 adjusts the rotational speed of the motor 23 based on the second error signal E2 so as to reduce a difference between the second reference speed $ENC_{ref}$ and the actual rotational speed of the speed detection roller 31 indicated by the speed signal S0.

The adder 36 adds the first and second error signals E1, E2 to generate the aforementioned drive signal V1.

The control circuit 25 is formed, for example, using a microcomputer (or a peripheral circuit if necessary). The reference speed generator 33 may, for example, be a memory. The memory used as the reference speed generator 33 stores the first reference speed $F_{ref}$ the second reference speed $ENC_{ref}$ and a correction value $ADJ_{ref}$ (to be described later).

(First Controller)

The first controller 34 includes a subtracter 34*a* configured to output a signal E11 including information on a difference between the first reference speed $F_{ref}$ generated by the reference speed generator 33 and the actual rotational speed F of the motor 23 detected by the FG 27.

The first controller 34 further includes an amplifier 34*b* configured to output a signal E12 obtained by amplifying the signal E11 output by the subtracter 34*a* with a given gain Kp.

The first controller 34 further includes a delay device 34*c* and an adder 34*d*. The delay device 34*c* outputs a delay component of the signal E11 output by the subtracter 34*a*. The adder 34*d* adds the signal E11 and the delay component output by the delay device 34*c* to output an integral signal E13.

The first controller 34 further includes an amplifier 34*e* configured to amplify the integral signal E13 with a given gain Ki to output a signal E14.

The first controller 34 further includes a delay device 34*f* and a subtracter 34*g*. The delay device 34*f* outputs a delay component of the signal E11 output by the subtracter 34*a*.

The subtracter 34*g* subtracts the delay component output by the delay device 34*f* from the signal E11 to output a differential signal E15.

The first controller 34 further includes an amplifier 34*h* configured to amplify the differential signal E15 with a given gain Kd to output a signal E16.

The first controller 34 includes an adder 34*i* configured to add the signals E12, E14 and E16 output from the amplifiers 34*b*, 34*e* and 34*h*, respectively to output a first error signal E1.

The first controller 34 executes a PID control using the abovementioned elements 34*a* to 34*i* to output the first error signal E1. The feedback control for the rotational speed of the motor 23 is accomplished by outputting the first error signal E1. As a result, the difference between the first reference speed $F_{ref}$ generated by the reference speed generator 33 and the actual rotational speed F of the motor 23 detected by the FG 27 is reduced with high responsiveness and stability.

(Second Controller)

The control by the second controller 35 is based on the speed signal S0 indicating the actual rotational speed of the speed detection roller 31 held in close contact with the transfer belt 16. Detection for the speed variation by the speed detection roller 31 is likely to largely delay. Further, the detected speed variation data includes high-frequency noise in many cases. Accordingly, the less responsive control by the second controller 35 may be more preferable rather than highly responsive control. Thus, in the embodiment, the control by the second controller 35 to respond at a lower frequency is accomplished using only an integral signal E24 without using any differential signal.

The second controller 35 includes a subtracter 35*a* configured to output a signal E21 including information on the difference between the second reference speed $ENC_{ref}$ generated by the reference speed generator 33 and the actual rotational speed of the speed detection roller 31 indicated by the speed signal S0.

The second controller 35 further includes an amplifier 35*b* configured to output a signal E22 obtained by amplifying the signal E21 output by the subtracter 35*a* with a given gain. In the embodiment, the amplifier 35*b* amplifies the signal E21 using a gain of "8".

The second controller 35 further includes an adder 35*c* configured to add the correction value $ADJ_{ref}$ stored in the reference speed generator 33 to the signal E22 output from the amplifier 35*b* to output an added signal E23. A manufacturer may calibrate individual differences among manufactured image forming apparatuses 1 using the correction value $ADJ_{ref}$ to be used for correction of the second reference speed $ENC_{ref}$.

The second controller 35 further includes a delay device 35*d* and an adder 35*e*. The delay device 35*d* outputs a delay component of the added signal E23. The adder 35*e* adds the added signal E23 and the delay component output by the delay device 35*d* to output an integral signal E24.

The second controller 35 further includes amplifiers 35*f*, 35*g*. The amplifier 35*f* outputs a signal obtained by amplifying the integral signal E24 with a given gain. In the embodiment, the amplifier 35*f* amplifies the integral signal E24 using a gain of "⅛". The amplifier 35*g* amplifies the signal output from the amplifier 35*f* with a given gain Ki2 to output a signal E25.

Variation in the diameter of the speed detection roller 31 is compensated by the amplifiers 35*b*, 35*f* and 35*g* and the adder 35*c*.

(Generation of Drive Signal)

The first controller 34 configured to output the first error signal E1 for controlling the rotational speed of the motor 23 compares the first reference speed $F_{ref}$ generated by the reference speed generator 33 with the actual rotational speed F of the motor 23 detected by the FG 27. Thereafter, the first controller 34 outputs the first error signal E1 for reducing the difference between the first reference speed $F_{ref}$ and the actual rotational speed F of the motor 23.

The second controller 35 compares the second reference speed $ENC_{ref}$ generated by the reference speed generator 33 with the actual rotational speed of the speed detection roller 31 indicated by the speed signal S0. Thereafter, the second controller 35 outputs the second error signal E2 for reducing the difference between the second reference speed $ENC_{ref}$ and the actual rotational speed of the speed detection roller 31 indicated by the speed signal S0.

The control circuit 25 includes the adder 36 in addition to the first and second controllers 34, 35. The adder 36 adds the first and second error signals E1, E2 to generate the drive signal V1 for the motor 23. The first error signal E1 output from the first controller 34 works for a responsive decrease in the speed variation of the motor 23. The second error signal E2 output from the second controller 35 works for a less responsive decrease in the speed variation resulting from the eccentricity of the motor 23 and/or the drive roller 21 as well as the variation in the thickness of the transfer belt 16. Thus, the running speed of the transfer belt 16 is accurately kept constant.

(Speed Detection Roller)

As shown in FIG. 1, the speed detection roller 31 includes a roller 31*a* held in close contact with the transfer belt 16. The roller 31*a* rotates as the transfer belt 16 runs.

The speed detection roller 31 further includes a rotary disk 31*c* coaxial with the roller 31*a*. A radial pattern 31*b* is formed in the rotary disk 31*c*. The rotary disk 31*c* rotates together with the roller 31*a*.

The speed detection roller 31 further includes a pair of sensors 31*e*, 31*f*. The sensors 31*e*, 31*f* arranged along a diameter of the rotary disk 31*c* are configured to read the pattern 31*b*. In the embodiment, one of the sensors 31*e*, 31*f* is exemplified as a first sensor and another as a second sensor. Pulse signals S1, S2 output from the sensors 31*e*, 31*f* are exemplified as roller information on the rotational speed of the speed detection roller 31 configured to rotate as the transfer belt 16 runs.

As shown in FIG. 2, the control circuit 25 includes an averaging circuit 31*g* configured to average output signals from the pair of sensors 31*e*, 31*f*. In the embodiment, the averaging circuit 31*g* is exemplified as an averaging portion configured to output an averaged sensor signal between the signals from the sensors 31*e*, 31*f*.

The averaging circuit 31*g* detects the rotational speed of the speed detection roller 31 based on pulse signals S1, S2 output from the sensors 31*e*, 31*f*. The averaging circuit 31*g* averages cycles of the pulse signals S1 and S2. The averaging circuit 31 outputs the speed signal S0 indicating the actual rotational speed of the speed detection roller 31 based on an averaged cycle between the pulse signals S1 and S2. The actual rotational speed of the speed detection roller 31 is calculated from an inverse of a product of the averaged cycle between the pulse signals S1 and S2 and a number of the pattern 31*b* formed in the rotary disk 31*c*. Alternatively, an averaged value between the actual rotational speeds of the speed detection roller 31 calculated from the pulse signals S1 and S2 may be determined as the actual rotational speed of the speed detection roller 31.

Arrangement of the sensors 31*e*, 31*f* along the diameter of the rotary disk 31*c* including the radial pattern 31*b* to be read by the sensors 31*e*, 31*f* and averaging operation by the averaging circuit 31*g* between the pulse signals S1, S2 from the sensors 31*e*, 31*f* contribute to a decrease in effect of the eccentricity of the speed detection roller 31 on the speed signal S0 indicating the actual rotational speed. Thus, the averaging circuit 31*g* outputs the speed signal S0 more accurately indicating the actual rotational speed of the speed detection roller 31.

(Filter)

As shown in FIG. 2, the control circuit 25 includes a moving average filter 41 exemplified as a second filter. The moving average filter 41 averages speed data during one or more revolutions of the motor 23.

The control circuit 25 further includes a comb filter 42 exemplified as a first filter. The comb filter 42 is configured to remove first frequency variation components, which vary depending on a rotational frequency of the speed detection roller 31, from the pulse signals S1, S2 from the sensors 31*e*, 31*f*. The first frequency variation components may be, for example, variation components which come from diameter tolerance, eccentric rotation and/or others relating to the speed detection roller 31. The aforementioned second controller 35 generates the second error signal E2 based on the signals (i.e. roller information) after removal of the first frequency variation components.

Figure 3:
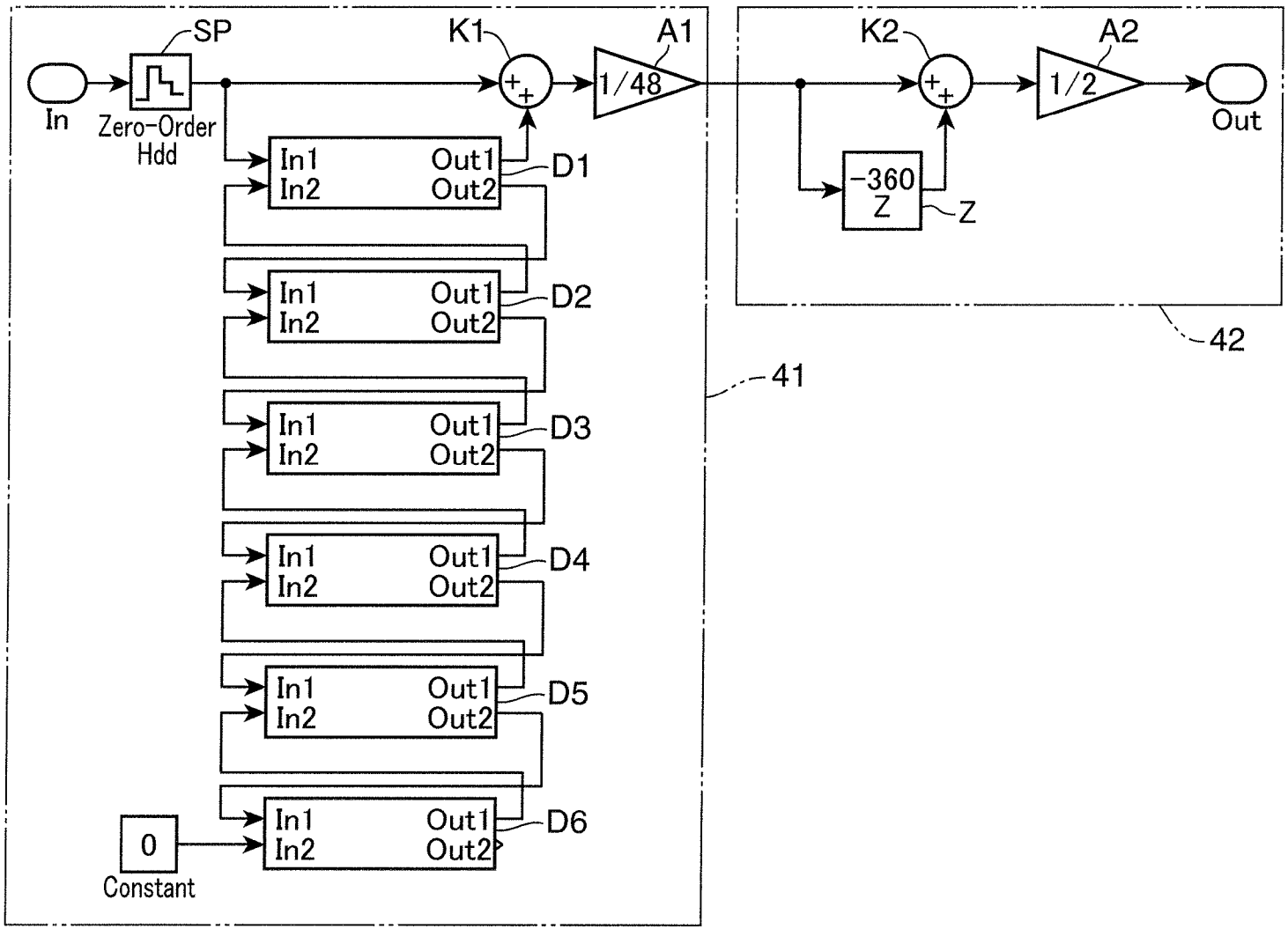
FIG. 3 is a block diagram showing a moving average filter and a comb filter of the control circuit shown in FIG. 2.

FIG. 3 is a block diagram showing configurations of the moving average filter 41 and the comb filter 42. With reference to FIGS. 2 and 3, the moving average filter 41 and the comb filter 42 are further described.

The moving average filter 41 includes a sampling circuit SP. The sampling circuit SP samples the speed signal S0 output from the averaging circuit 31*g* in a given cycle. The sampling cycle by the sampling circuit SP is preferably set to be substantially equal to the pulse cycles from the sensors 31*e*, 31*f*. As a result, the sampling circuit SP samples the speed signal S0 every generation of the speed signal S0 indicating the actual rotational speed of the speed detection roller 31 by the averaging circuit 31*g*.

The moving average filter 41 further includes delay adders D1 to D6. In the embodiment, six delay adders D1 to D6 are used. Alternatively, the moving average filter 41 may include five or less delay adders or seven or more delay adders. In the following description, reference numeral D is used when the delay adders D1 to D6 are collectively termed.

The moving average filter 41 further includes an adder K1 and an attenuator A1.

Figure 4:
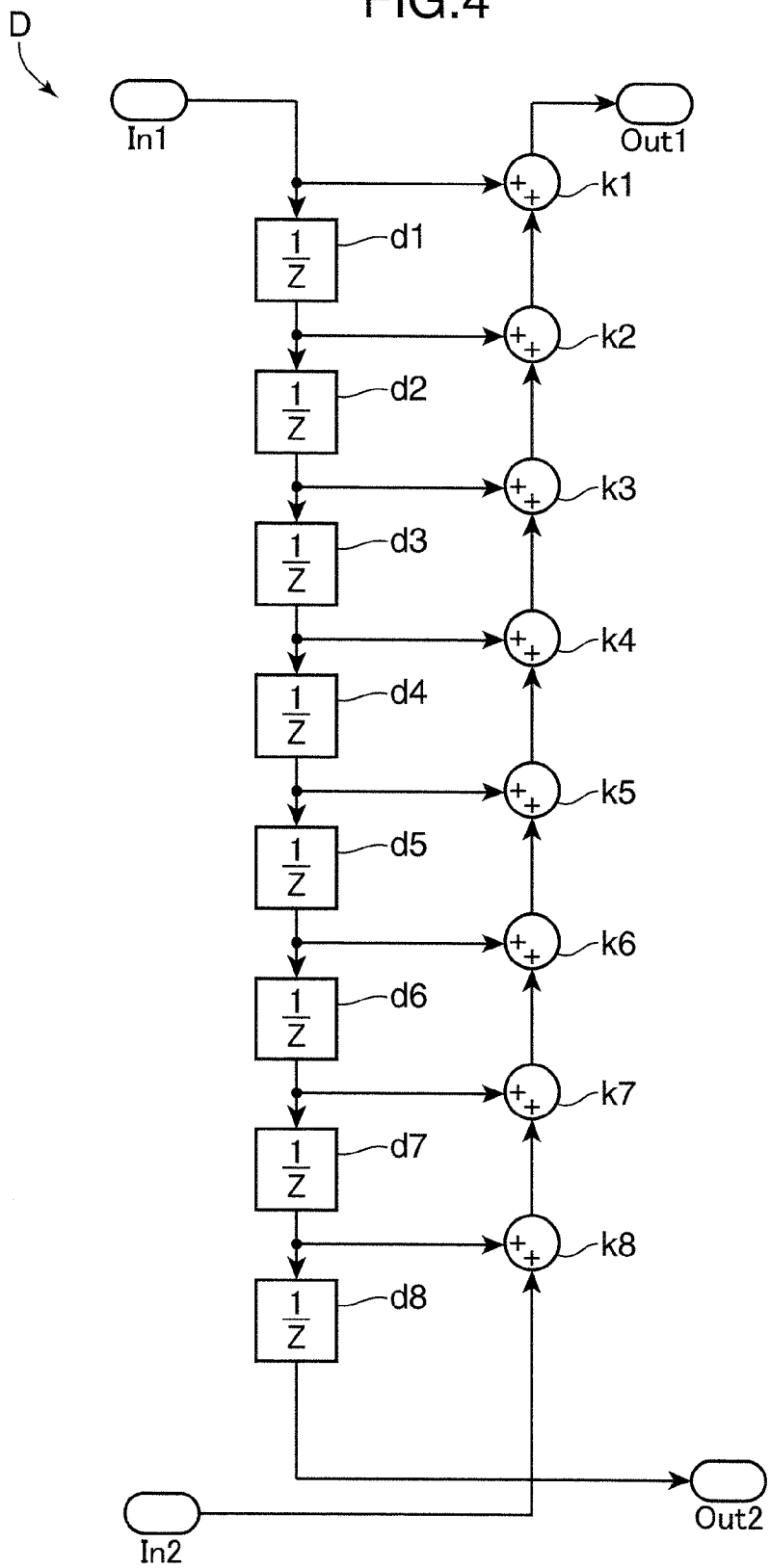
FIG. 4 is a block diagram showing a delay adder of the moving average filter shown in FIG. 3.

FIG. 4 is a block diagram showing the delay adder D. With reference to FIGS. 3 and 4, the delay adder D is described.

The delay adder D includes delay circuits d1 to d8 connected in series. In the embodiment, eight delay circuits d1 to d8 are used. Alternatively, seven or less delay circuits or nine or more delay circuits may be used.

The delay adder D further includes as many adders k1 to k8 as the delay circuits d1 to d8.

The delay adder D further includes a first input terminal In1 and a second input terminal In2, to which signals are to be input. The delay adder D further includes a first output terminal Out1 and a second output terminal Out2, from which signals are to be output.

A signal input to the first input terminal In1 is successively delayed by the delay circuits d1 to d8, respectively, and finally output from the second output terminal Out2. The signal input to the first input terminal In1 is also output to the adder k1. The signal output from the delay circuit d1 is output to the adder k2 as well as to the delay circuit d2. Similarly, the signals output from the delay circuits d2 to d6 are also output to the adders k3 to k7, respectively. Finally, the signal output from the delay circuit d7 is output to the adder k8 as well as to the delay circuit d8.

The adders k1 to k8 successively add the signals output from the delay circuits d7 to d1 to a signal input to the second input terminal In2, respectively, and finally adds the signal input to the first input terminal In1 to the signal input to the second input terminal In2. The signal input to the second input terminal In2 is initially input to the adder k8. The adder k8 adds the signal input to the second input terminal In2 to the signal output from the delay circuit d7 and outputs an added signal to the adder k7. The adder k7 adds the added signal from the adder k7 to the output signal from the delay circuit d6 and outputs the resulting signal to the adder k6. Finally, the adder k1 adds the added signal from the adder k2 to the signal input to the first input terminal In1 and outputs the resulting signal to the first output terminal Out1.

In this way, the signal input to the first input terminal In1 of the delay adder D is output from the second output terminal Out2 after being delayed. Further, the signal input to the second input terminal In2 of the delay adder D is output from the first output terminal Out1 after the aforementioned adding process.

As shown in FIG. 3, a signal input to the first input terminal In1 of the delay adder D1 is output from the second output terminal Out2 of the delay adder D1 after being delayed. The signal output from the second output terminal Out2 of the delay adder D1 is input to the first input terminal In1 of the delay adder D2 and output from the second output terminal Out2 of the delay adder D2 after the aforementioned adding process. Finally, the signal input to the first input terminal In1 of the delay adder D6 from the second output terminal Out2 of the delay adder D5 is output from the second output terminal Out2 of the delay adder D6 after being delayed. In the embodiment, the second output terminal Out2 of the delay adder D6 is open.

A signal input to the second input terminal In2 of the delay adder D6 is output from the first output terminal Out1 of the delay adder D6. The signal output from the first output terminal Out1 of the delay adder D6 is input to the second input terminal In2 of the delay adder D5 and output from the first output terminal Out1 of the delay adder 5 after the aforementioned adding process. Finally, the signal input to the second input terminal In2 of the delay adder D1 from the first output terminal of the delay adder D2 is output from the first output terminal Out1 of the delay adder D1 after the aforementioned adding process.

In the embodiment, the speed signal S0 indicating the actual rotational speed sampled by the sampling circuit SP is input to the first input terminal In1 of the delay adder D1. Further, a fixed value "0" is input to the second input terminal In2 of the delay adder D6.

The adder K1 adds an output signal of the sampling circuit SP to an output signal from the first output terminal Out1 of the delay adder D1. In this way, the moving average filter 41 successively updates time series data of 48 samples (6×8 samples) to obtain a sum value. The attenuator A1 attenuates the sum value calculated by the adder K1 (output signal from the adder K1) to 1/48. The attenuator A1 then outputs the attenuated signal to the comb filter 42.

In the embodiment, the decelerator shown in FIG. 1 may include a gear with 105 teeth and a pinion with 7 teeth. The decelerator 24 with a deceleration ratio of 15 (105/7) causes one revolution of the drive roller 21 during 15 revolutions of the motor 23.

In the embodiment, the diameter of the drive roller 21 may be set at 40 mm. The diameter of the roller 31*a* may be set at 20 mm. The roller 31*a* rotates two revolutions during one revolution of the drive roller 21.

In the embodiment, the sensors 31*e*, 31*f* respectively generate 360 pulses (720 pulses in total) during one revolution of the roller 31*a*. In this way, 720 pulses in total, which corresponds to one revolution of the roller 31*a*, are output from the sensors 31*e*, 31*f* during a half revolution of the roller 31*a*. The averaging circuit 31*g* averages intervals between the pulses output from the sensor 31*e* and those between the pulses output from the sensor 31*f* to calculate 360 average values. The 360 average values are output as the speed signal S0 indicating the actual rotational speed of the speed detection roller 31, respectively. Accordingly, 360 datasets included in the speed signal S0 output from the averaging circuit 31*g* to indicate the actual rotational speed of the speed detection roller 31 correspond to one revolution of the roller 31*a*.

The 48 samples included in the time series data successively updated by the moving average filter 41 may represent the speed data (720/48/2×2=15) during one revolution of the motor 23. In this way, the moving average filter 41 executes moving average (or moving integration) for the outputs from the sensors 31*f*, 31*e* corresponding to one revolution of the motor 23 to remove a periodic component of the motor 23.

In the embodiment, a feed forward type of the comb filter 42 is used. The comb filter 42 includes a delay device Z and an adder K2. Output signals from the moving average filter 41 are input to the delay device Z and the adder K2. The adder K2 adds output signals from the moving average filter 41 and the delay device Z.

The comb filter 42 further includes an attenuator A2. In the embodiment, a gain of the attenuator A2 is set at "½". Thus, the attenuator A2 averages a signal input to the delay device Z and a signal output from the delay device Z.

The delay device Z retains data for a period corresponding to a ½ revolution of the speed detection roller 31. As described above, the sensors 31*e*, 31*f* generate 720 pulses in total during one revolution of the roller 31*a*. The comb filter 42 adds a dataset obtained earlier by a period of 360 pulses, which corresponds to a ½ revolution of the roller 31*a*, to a dataset input from the moving average filter 41. The comb filter 42 further attenuates the sum value to ½ to average the dataset obtained earlier and that input from the moving average filter 41. The drive roller 21 rotates a ¼ revolution during a ½ revolution of the roller 31*a*. Accordingly, the averaging process executed by the comb filter 42 results in averaging the rotational speeds of the drive roller 21 at a different phase shifted by 90°. Thus, a periodic component of the drive roller 21 is removed.

For example, when the motor 23 rotates at rotational speed of 40.82325 rps, the drive roller 21 of 40 mm in diameter rotates at 2.72155 rps via the decelerator 24 with a deceleration ratio of 15 (the number of teeth of the gear: 105, the number of teeth of the pinion: 7). As a result, the roller 31*a* of 20 mm in diameter rotates at 5.4431 rps.

In the embodiment, the comb filter 42 is characterized in dips at 2.7 Hz and 40 Hz. The dip at 2.7 Hz corresponds to the drive roller 21. The dip at 40 Hz corresponds to the motor 23 and appropriately removes the second frequency variation component varying at the rotational frequency of the motor 23. Thus, in the embodiment, the second controller 35 generates the second error signal E2 based on the signal after removal of the abovementioned first and second frequency variation components (i.e. roller information).

The comb filter 42 is also characterized in a filtering property at 5.4 Hz. The filtering property at 5.4 Hz corresponds to the speed detection roller 31. As described above, when the decelerator 24 performs a single step of the deceleration, the components resulting from the decelerator 24 and the drive roller 21 have the same frequency. The same frequency components of the decelerator 24 and the drive roller 21 are removed by the comb filter 42.

(Bode Diagrams)

Figure 5:
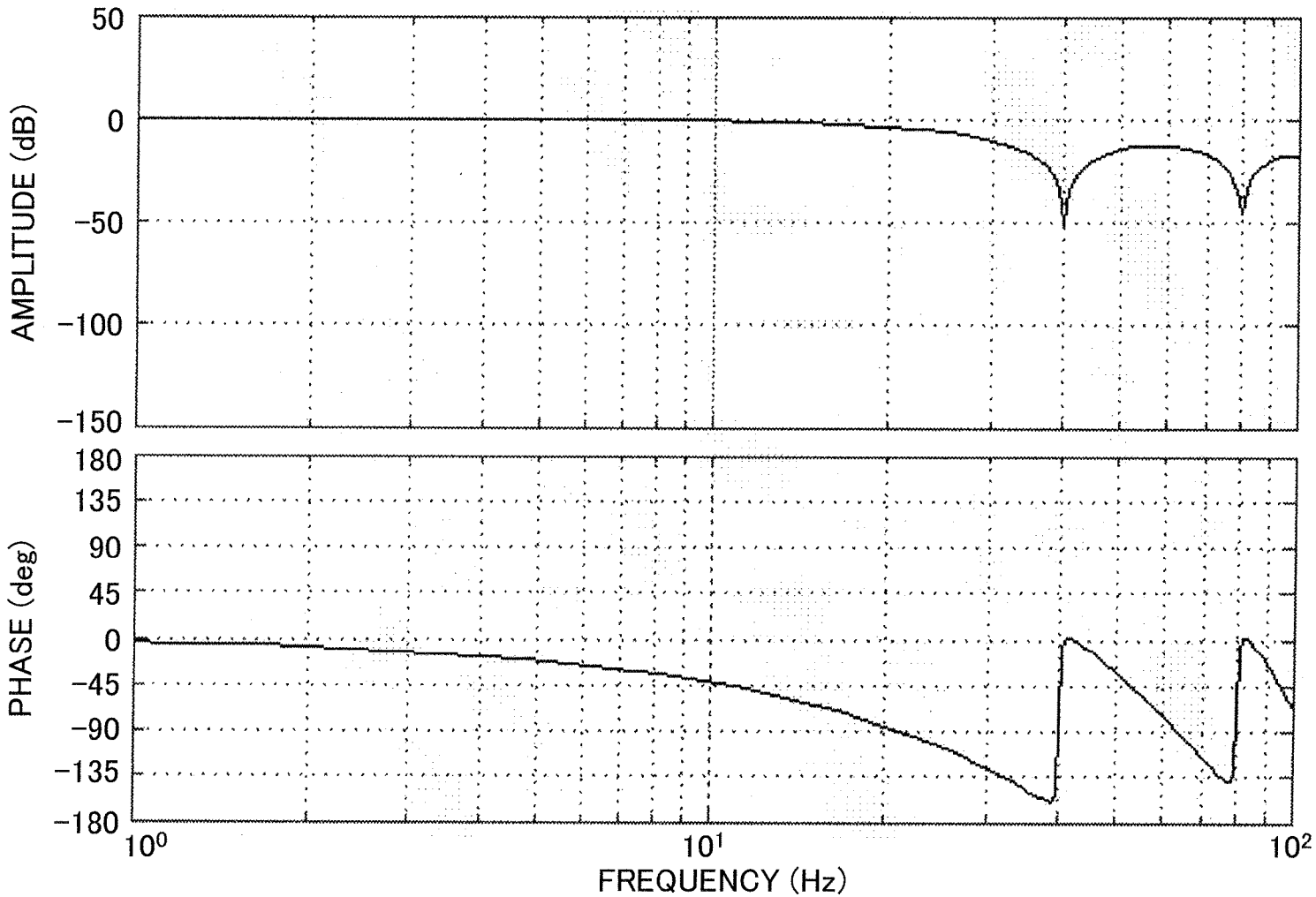
FIG. 5 is a Bode diagram showing characteristics of the moving average filter shown in FIG. 3.
Figure 6:
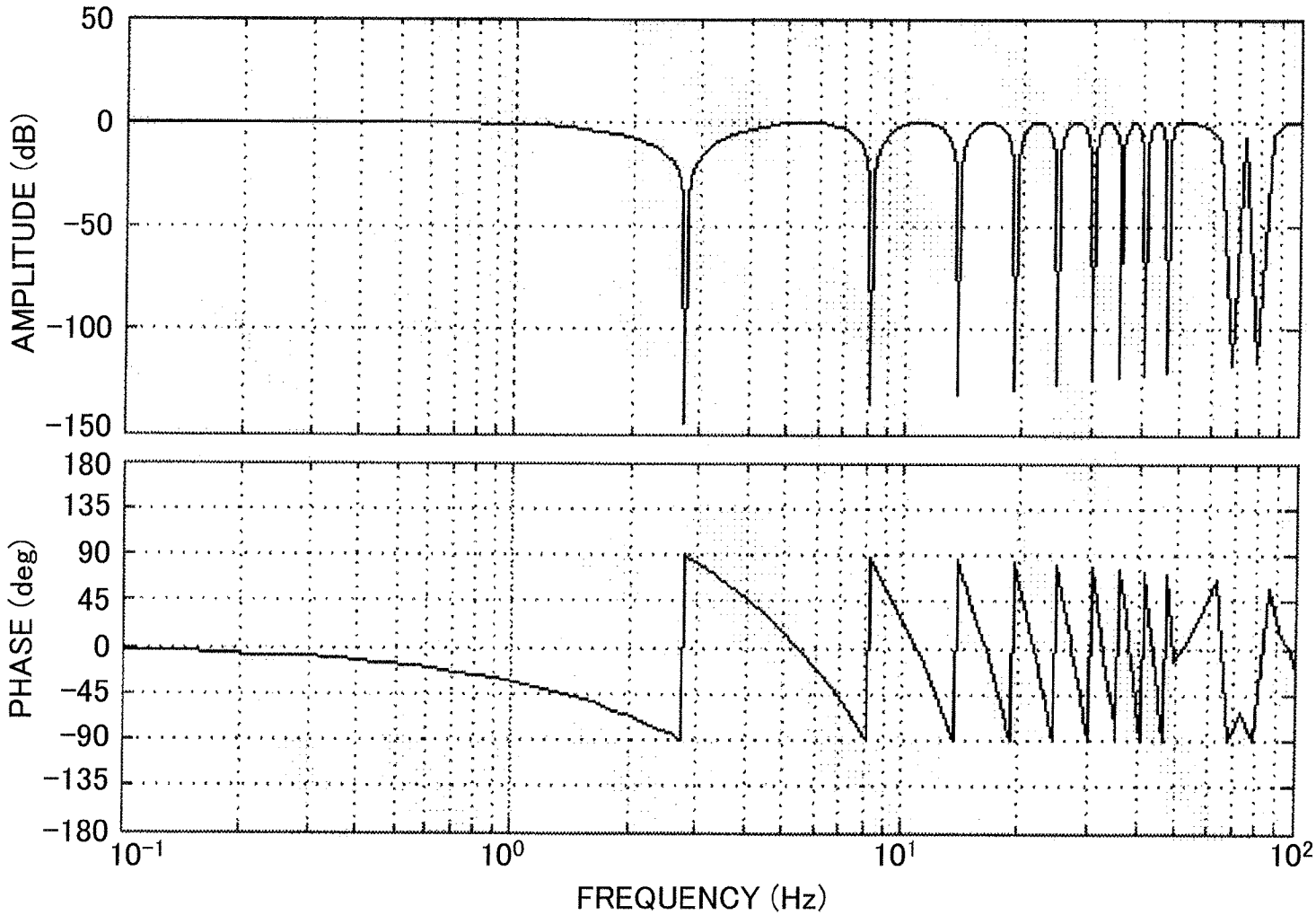
FIG. 6 is a Bode diagram showing characteristics of the comb filter shown in FIG. 3.
Figure 7:
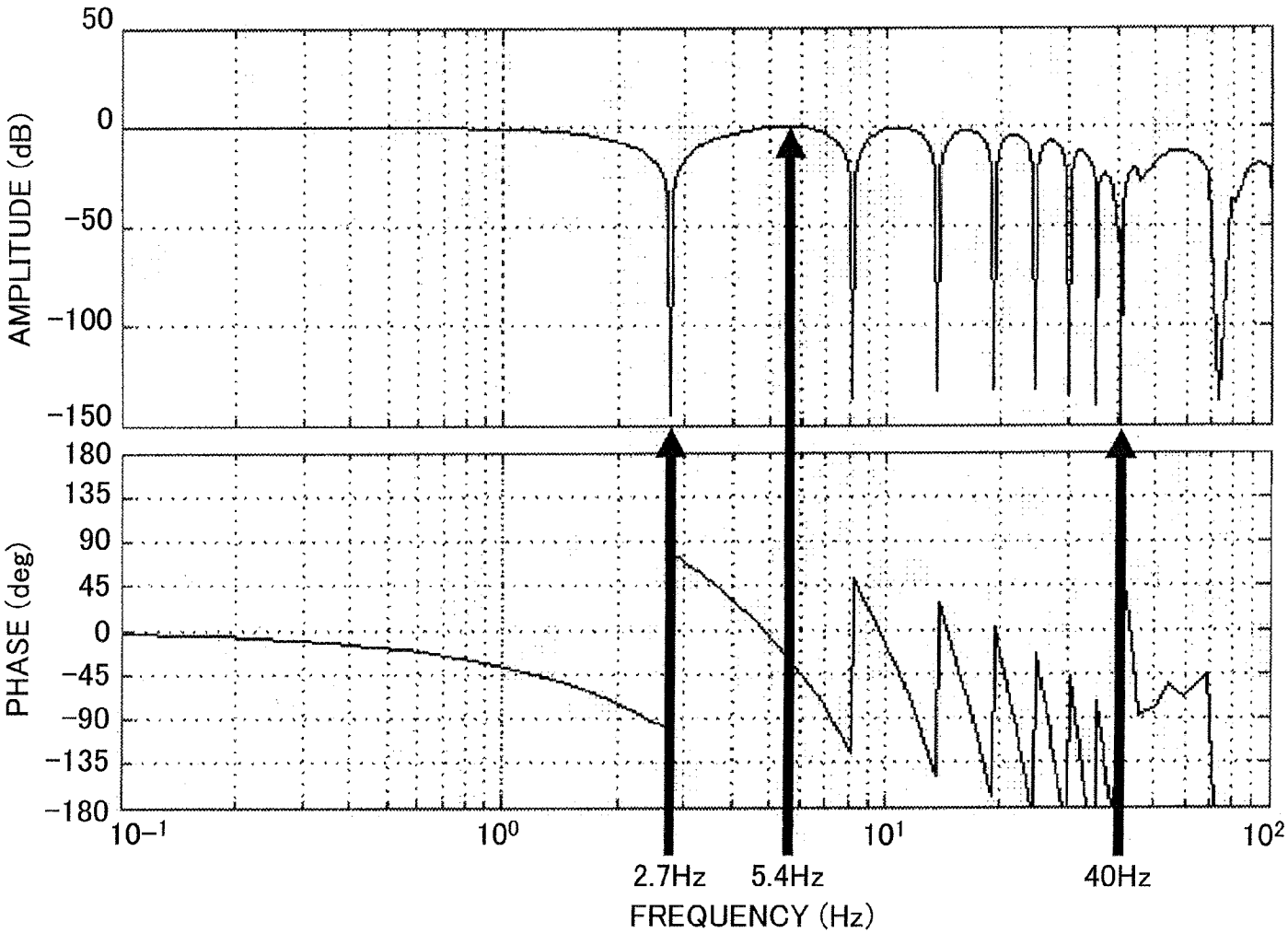
FIG. 7 is a Bode diagram showing combined characteristics of the moving average filter and the comb filter shown in FIG. 3.

FIG. 5 is a Bode diagram of the moving average filter 41. FIG. 6 is a Bode diagram of the comb filter 42. FIG. 7 is a Bode diagram obtained by combining the Bode diagram shown in FIG. 5 and FIG. 6.

The moving average filter 41 configured to execute the moving average for the data corresponding to one rotation of the motor 23 has dips at 40 Hz and 80 Hz (40 Hz×2). As shown in FIG. 7, the periodic component of the drive roller 21 at 2.7 Hz is removed by using the moving average filter 41 and the comb filter 42. The component of the speed detection roller 31 at 5.4 Hz (2.7 Hz×2) appears in the Bode diagram as a gain "1". In this way, the variation component resulting from the speed detection roller 31 is detected. Based on the detected variation component, the feed forward control is executed to appropriately correct the variation resulting from the speed detection roller 31.

In the embodiment, the responsive first controller 34 decreases the speed variation resulting from the motor 23 configured to drive the drive roller 21. An AC component noise (e.g. noise depending on assembly accuracy of the decelerator 24, accuracy in diameter of the drive roller 21 and thickness of the transfer belt 16), which may remain after the suppressive process by the first controller 34 to decrease the speed variation component, is suppressed by the second controller 35. As a result, the transfer belt 16 runs at more accurate speed.

The speed detection roller 31 configured to rotate as the transfer belt 16 runs is used for the embodiment. The second controller 35 samples the rotational speed of the speed detection roller 31 per one revolution of the motor 23. As a result, cyclic components corresponding to the revolution of the motor 23 are removed. Thus, the transfer belt 16 runs at substantially constant speed.

The comb filter 42 of the second controller 35 extracts periodic variation components resulting from the rotation of the speed detection roller 31 from the output signal of the speed detection roller 31. As a result, factors such as the diameter variation and eccentricity of the speed detection roller 31 are extracted. The extracted factors are appropriately removed by the feedback control. In this way, the speed of the transfer belt 16 is more accurately corrected.

In the embodiment, the comb filter 42 configured to extract the periodic variation components of the speed detection roller 31 removes frequency components resulting from the rotations of the motor 23 and the drive roller 21. The comb filter 42 preferably removes several bands of the frequency components. As a result, the comb filter 42 appropriately extracts the components depending on the diameter accuracy of the speed detection roller 31 and the eccentricity of the speed detection roller 31 to correct the speed.

The control circuit 25 includes the moving average filter 41 connected in series with the comb filter 42. The moving average filter 41 averages speed data corresponding to one or more revolutions of the motor 23. As a result, periodic noise of the motor 23 (mainly noise resulting from the eccentric rotation of the motor 23) is smoothed or removed while the second controller 35 feedback-controls the motor 23 based on the rotational speed of the speed detection roller 31.

As shown in FIG. 1, the speed detection roller 31 is preferably arranged at an upstream position of the drive roller 21 (in the direction of the arrow 15). The speed detection roller 31 may more accurately detect the running speed of the transfer belt to which proper tension is applied at the upstream position of the drive roller 21, comparing with detection of the running speed of the transfer belt 16 at a downstream position where the transfer belt 16 is likely to slack.

It is preferable to place the speed detection roller 31 as close to the drive roller 21 as possible. As a result, noise resulting from the expansion and contraction of the transfer belt 16 is decreased, so that the running speed of the transfer belt 16 is more accurately detected.

The image forming apparatus according to one aspect of the above embodiment configured to form a toner image on a sheet includes a transfer belt forbearing the toner image. The transfer belt transfers the toner image to the sheet conveyed at a given conveying speed. The image forming apparatus further includes a drive roller configured to drive the transfer belt and a speed detection roller held in contact with the transfer belt. The speed detection roller outputs roller information on rotational speed of the speed detection roller when the speed detection roller rotates as the transfer belt runs. The image forming apparatus further includes a motor configured to drive the drive roller, a motor speed output portion configured to output motor information on rotational speed of the motor and a control element configured to control the rotational speed of the motor, wherein the control element includes a reference speed generator configured to generate first reference speed as a reference for the rotational speed of the motor and second reference speed as a reference for the rotational speed of the speed detection roller based on the given conveying speed of the sheet, a first controller configured to generate a first error signal for reducing a difference between the rotational speed of the motor obtained from the motor information and the first reference speed, a second controller configured to generate a second error signal for reducing a difference between the rotational speed of the speed detection roller obtained from the roller information and the second reference speed, and an adder configured to add the first and second error signals and output a drive signal for driving the motor.

According to the above configuration, the image forming apparatus forms a toner image on a sheet. The transfer belt of the image forming apparatus bears the toner image. The transfer belt driven by the drive roller transfers the toner image to the sheet conveyed at the given conveying speed. The speed detection roller held in contact with the transfer belt outputs the roller information on the rotational speed of the speed detection roller when the speed detection roller rotates as the transfer belt runs. The motor speed output portion outputs the motor information on the rotational speed of the motor configured to drive the drive roller. The control element configured to control the rotational speed of the motor includes the reference speed generator configured to generate the first reference speed as a reference for the rotational speed of the motor and the second reference speed as a reference for the rotational speed of the speed detection roller based on the given sheet conveying speed. The first controller of the control element generates the first error signal for reducing the difference between the rotational speed of the motor obtained from the motor information and the first reference speed. The second controller of the control element generates the second error signal for reducing the difference between the rotational speed of the speed detection roller obtained from the roller information and the second reference speed. The adder of the control element adds the first and second error signals to output the drive signal for driving the motor. Accordingly, variation of the running speed of the transfer belt resulting from the rotation of the motor is decreased by the first error signal generated by the first controller. Variation of the running speed of the transfer belt resulting from the speed detection roller is decreased by the second error signal generated by the second controller. Thus, the running speed of the transfer belt is more accurately controlled.

In the above configuration, it is preferable that the control element includes a first filter configured to remove from the roller information a first frequency variation component varying at the rotational frequency of the speed detection roller, and that the second controller generates the second error signal using the roller information after removal of the first frequency variation component.

According to the above configuration, the first filter removes from the roller information the first frequency variation component varying at the rotational frequency of the speed detection roller. The second controller generates the second error signal using the roller information after the removal of the first frequency variation component, so that the variation component resulting from the speed detection roller for the rotation control of the motor is less likely to be used.

In the above configuration, it is preferable that the motor information includes speed data obtained during at least one revolution of the motor; that the control element includes a second filter connected in series with the first filter; and that the second filter averages the speed data.

According to the above configuration, the motor information includes the speed data obtained during at least one revolution of the motor. The second filter connected in series with the first filter averages the speed data. Thus, the variation component varying at the rotational frequency of the motor is smoothed. Thus, a preferable motor control is accomplished.

In the above configuration, it is preferable that the first filter further removes from the roller information a second frequency variation component varying at the rotational frequency of the motor; and that the second controller generates the second error signal using the roller information after removal of the first and second frequency variation components.

According to the above configuration, the first filter removes from the roller information the second frequency variation component varying at the rotational frequency of the motor. The second controller generates the second error signal using the roller information after the removal of the first and second frequency variation components. Thus, the variation components resulting from the speed detection roller and the motor is less likely to be used for the rotation control of the motor.

In the above configuration, the speed detection roller includes a roller held in contact with the transfer belt. The roller rotates as the transfer belt runs. The speed detection roller further includes a rotary disk configured to coaxially rotate with the roller. A radial pattern is formed in the rotary disk. The speed detection roller includes a first sensor configured to read the pattern and a second sensor configured to read the pattern at a position different from the first sensor. Preferably, the control element includes an averaging portion configured to output as the speed data an averaged sensor signal between signals from the first sensor and the second sensor.

According to the above configuration, the roller held in contact with the transfer belt rotates as the transfer belt runs. The rotary disk configured to coaxially rotate with the roller is formed with the radial pattern. The first and second sensors read the pattern. The averaging portion outputs as the speed data the averaged sensor signal between signals from the first sensor and the second sensor. As a result, a variation component resulting from the eccentricity of the speed detection roller is appropriately reduced.

In the above configuration, the speed detection roller is held in contact with the transfer belt at an upstream position of the drive roller.

According to the above configuration, the speed detection roller is held in contact with the transfer belt under given tension. Thus, the rotation of the speed detection roller appropriately reflects the running speed of the transfer belt.

In the above configuration, the speed detection roller is held in contact with the transfer belt near the drive roller.

According to the above configuration, the roller information from the speed detection roller held in contact with the transfer belt near the drive roller is less likely to be affected by the expansion and contraction of the transfer belt.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

This application is based on Japanese Patent application serial No. 2009-178177 filed in Japan Patent Office on Jul. 30, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus configured to form a toner image on a sheet, comprising:

a transfer belt configured to bear and transfer the toner image to the sheet conveyed at given conveying speed;

a drive roller configured to drive the transfer belt;

a motor configured to drive the drive roller;

a speed detection roller held in contact with the transfer belt and configured to output speed data about rotational speed of the speed detection roller when the speed detection roller rotates as the transfer belt runs, the speed data being obtained during at least one revolution of the motor;

a motor speed output portion configured to output motor information on rotational speed of the motor; and a control element configured to control the rotational speed of the motor, wherein the control element includes:

a reference speed generator configured to generate first reference speed as a reference for the rotational speed of the motor and second reference speed as a reference for the rotational speed of the speed detection roller based on the given conveying speed of the sheet;

a first controller configured to generate a first error signal for reducing a difference between the rotational speed of the motor obtained from the motor information and the first reference speed;

a second controller configured to generate a second error signal for reducing a difference between the rotational speed of the speed detection roller obtained from the speed data and the second reference speed; and an adder configured to add the first and second error signals and output a drive signal for driving the motor, the speed detection roller includes:

a roller held in contact with the transfer belt and configured to rotate as the transfer belt runs;

a rotary disk configured to coaxially rotate with the roller and formed with a radial pattern;

a first sensor configured to read the pattern; and a second sensor configured to read the pattern at a position different from the first sensor, the first and second sensors are aligned along a diameter of the rotary disk;

the control element includes an averaging portion configured to output, as the speed data, an averaged sensor signal between signals from the first sensor and the second sensor, a first filter and a second filter connected in series with the first filter, the control element outputs the speed data to the second filter, the second filter converts the speed data output from the averaging portion into moving average speed data to remove a periodic component of the motor and outputs the moving average speed data to the first filter, the first filter removes a first frequency variation component varying at a rotational frequency of the speed detection roller and a second frequency variation component varying at a rotational frequency of the motor from the moving average speed data, and the second controller receives the moving average speed data from the first filter after removal of the first and second frequency variation components to generate the second error signal.

2. The image forming apparatus according to claim 1, wherein the first filter includes a first dip in correspondence to the drive roller, a second dip in correspondence to the motor, and a third dip in correspondence to the speed detection roller.

3. The image forming apparatus according to claim 1, wherein the speed detection roller is held in contact with the transfer belt at an upstream position of the drive roller.

4. The image forming apparatus according to claim 3, wherein the speed detection roller is held in contact with the transfer belt near the drive roller.

5. The image forming apparatus according to claim 1, wherein the first controller compares the first reference speed to the first rotational speed of the speed detection roller obtained from the speed data.

6. The image forming apparatus according to claim 1, wherein the second controller compares the second reference speed to the rotational speed of the speed detection roller obtained from the speed data.

7. The image forming apparatus according to claim 1, wherein the first error signal causes a decrease in a speed variation of the motor.

8. The image forming apparatus according to claim 7, wherein the second error signal causes a decrease in a speed variation resulting from eccentricity of the motor and the drive roller.

9. The image forming apparatus according to claim 7, wherein the decrease caused by the second error signal is less responsive than the decrease caused by the first error signal.

10. The image forming apparatus according to claim 9, wherein the first controller includes (i) a first subtracter configured to output a first information signal about a difference between the first reference speed and the first rotational speed of the speed detection roller obtained from the speed data, (ii) a first delay device configured to output a first delay component of the first information signal and (iii) a second subtracter that subtracts the first delay component from the first information signal to output a differential signal, and the differential signal is used for generating the first error signal.

11. The image forming apparatus according to claim 10, wherein the second controller includes (i) a third subtracter configured to output a second information signal about a difference between the second reference speed and the rotational speed of the speed detection roller obtained from the speed data, (ii) a first adder that adds a correction value to correct the second reference speed and outputs a corrected signal, (iii) a second delay device configured to output a second delay component from the second information signal and (iv) a second adder that adds the second delay component to the corrected signal to output an integral signal, and the second controller exclusively uses the integral signal to cause the less responsive decrease than the decrease caused by the first error signal.

* * * * *